US009825411B2

(12) United States Patent
Wu et al.

(10) Patent No.: US 9,825,411 B2
(45) Date of Patent: Nov. 21, 2017

(54) POWER CABLE CONNECTOR ASSEMBLY

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Zheng-Rong Zhu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/159,837

(22) Filed: May 20, 2016

(65) Prior Publication Data

US 2016/0344144 A1 Nov. 24, 2016

(30) Foreign Application Priority Data

May 22, 2015 (CN) ..... 2015 1 0262922

(51) Int. Cl.

| | |
|---|---|
| ***H01R 13/66*** | (2006.01) |
| ***H01R 9/16*** | (2006.01) |
| ***H01R 24/30*** | (2011.01) |
| *H01R 103/00* | (2006.01) |

(52) U.S. Cl.

CPC ..... *H01R 13/6683* (2013.01); *H01R 9/16* (2013.01); *H01R 24/30* (2013.01); *H01R 2103/00* (2013.01)

(58) Field of Classification Search

CPC ..... H01R 13/6616; H01R 13/6625; H01R 13/6641; H01R 13/6658; H01R 13/6666

USPC ..... 439/620.21

See application file for complete search history.

(56) References Cited

U.S. PATENT DOCUMENTS

| | | | | |
|---|---|---|---|---|
| 4,915,639 | A * | 4/1990 | Cohn | G06K 7/10861 307/116 |
| 5,315,476 | A * | 5/1994 | Hedrick | H01R 13/713 200/302.2 |
| 5,401,180 | A * | 3/1995 | Muzslay | H01R 13/7032 102/202.2 |
| 5,926,440 | A * | 7/1999 | Chien | F21S 8/035 362/253 |
| 6,062,883 | A * | 5/2000 | Schreiber | H01R 13/633 439/159 |
| 6,176,718 | B1 * | 1/2001 | Skarie | H01R 13/64 439/188 |

(Continued)

FOREIGN PATENT DOCUMENTS

CN 104201519 A 12/2014

*Primary Examiner* — Abdullah Riyami
*Assistant Examiner* — Vladimir Imas
(74) *Attorney, Agent, or Firm* — Wei Te Chung; Ming Chieh Chang

(57) ABSTRACT

A power cable connector assembly includes: an electrical connector including an insulative housing, a number of contacts retained in the insulative housing, and an outer case enclosing the insulative housing; a cable electrically connecting with the electrical connector, the cable including a number of core wires connected with corresponding contacts and a number of control wires; and a sensor enclosed by the outer case, the sensor including a number of conductive wires connected with corresponding control wires and a mounting portion, the mounting portion having a through hole for fixing the sensor to the insulative housing.

17 Claims, 12 Drawing Sheets

(56) References Cited

U.S. PATENT DOCUMENTS 6,577,081 B2 * 6/2003 Dickie ..... H05B 33/08 315/363
6,692,284 B1 * 2/2004 Koh ..... B60L 3/0069 439/346
6,802,741 B1 * 10/2004 Shatkin ..... H01R 13/7137 200/51 R
7,196,885 B2 * 3/2007 Pierce ..... F21V 33/00 361/42
7,217,147 B2 * 5/2007 Yoshida ..... H01R 13/53 439/181
7,249,976 B1 * 7/2007 Watson ..... H01R 13/71 200/51.07
7,347,737 B2 * 3/2008 Horiba ..... H01R 13/6464 439/676
7,399,205 B2 * 7/2008 McNeely ..... A61B 5/0006 340/12.39
7,416,448 B2 * 8/2008 Gaidosch ..... H01R 9/031 439/607.41
7,480,123 B2 * 1/2009 Jones ..... H01R 13/6616 361/42
7,500,888 B2 * 3/2009 Roset ..... H01R 11/281 439/754
7,847,703 B2 * 12/2010 Bauschke ..... H01R 13/6658 340/568.2
7,965,075 B2 * 6/2011 Mueller ..... G01D 11/245 324/173
8,523,602 B2 * 9/2013 Figie ..... H01R 13/6581 439/466
8,565,966 B2 * 10/2013 Langlais ..... G01F 23/0007 701/34.3
8,668,347 B2 * 3/2014 Ebeling ..... H01R 13/5213 174/66
8,736,226 B2 * 5/2014 Mukai ..... B60L 3/0069 320/104
8,884,773 B2 * 11/2014 Wiesemann ..... B60L 3/0069 320/109
8,951,075 B2 * 2/2015 Ekchian ..... H01R 13/4538 439/170
9,325,129 B2 * 4/2016 Soneda ..... H01R 25/003
9,356,440 B2 * 5/2016 Aromin ..... H02H 3/167
9,373,912 B1 * 6/2016 Juds ..... H01R 13/53
9,425,566 B2 * 8/2016 Lee ..... H01R 25/003
9,431,776 B2 * 8/2016 Futakuchi ..... H01R 13/6683
2009/0316321 A1 * 12/2009 Ouwerkerk ..... H02H 5/046 361/106
2016/0104978 A1 4/2016 Chaumeny et al.
2016/0104988 A1 4/2016 Lee

* cited by examiner

POWER CABLE CONNECTOR ASSEMBLY

BACKGROUND OF THE INVENTION

1. Field of the Invention

The present invention relates to a power cable connector, and more particularly to a power cable connector having a temperature control function.

2. Description of the Related Art

U.S. Patent Application Publication No. 2016/0104978, issued on Apr. 14, 2016, discloses an electrical apparatus comprising an electrically insulating body housing at least two electrical connection elements and a temperature sensor.

The temperature sensor is received in a thermally conductive and electrically insulating support element which is separate from and mounted inside the body.

U.S. Patent Application Publication No. 2016/0104988, issued on Apr. 14, 2016, discloses a power plug having a temperature sensor element positioned therein. The temperature sensor element may have a temperature sensor pin. When the temperature sensed by the temperature sensor element is higher than the first threshold value, the temperature element produces a first sense signal through the signal processing circuit. When the temperature sensed by the first threshold value, the temperature sensor element may transmit another sense signal.

A power cable connector assembly having an improved sensor mounting structure is desired.

BRIEF SUMMARY OF THE INVENTION

An object of the present invention is to provide a power cable connector assembly having an improved sensor mounting structure.

In order to achieve above-mentioned object, a power cable connector assembly comprises: an electrical connector including an insulative housing, a plurality of contacts retained in the insulative housing, and an outer case enclosing the insulative housing; a cable electrically connecting with the electrical connector, the cable including a plurality of core wires connected with corresponding contacts and a plurality of control wires; and a sensor enclosed by the outer case, the sensor including a plurality of conductive wires connected with corresponding control wires and a mounting portion, the mounting portion having a through hole for fixing the sensor to the insulative housing.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
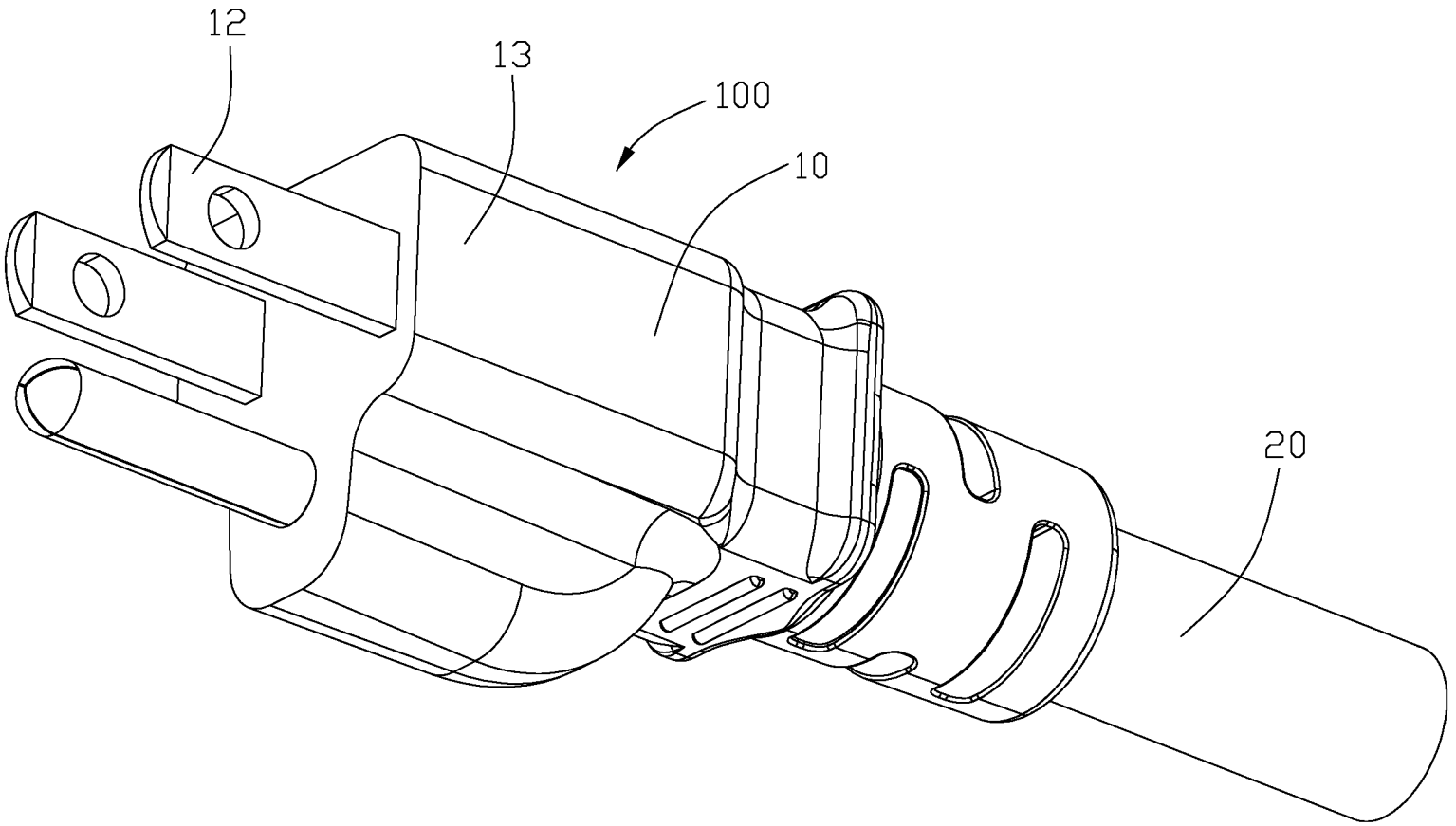
FIG. 1 is a perspective view showing a power cable connector assembly in accordance with the present invention.
Figure 2:
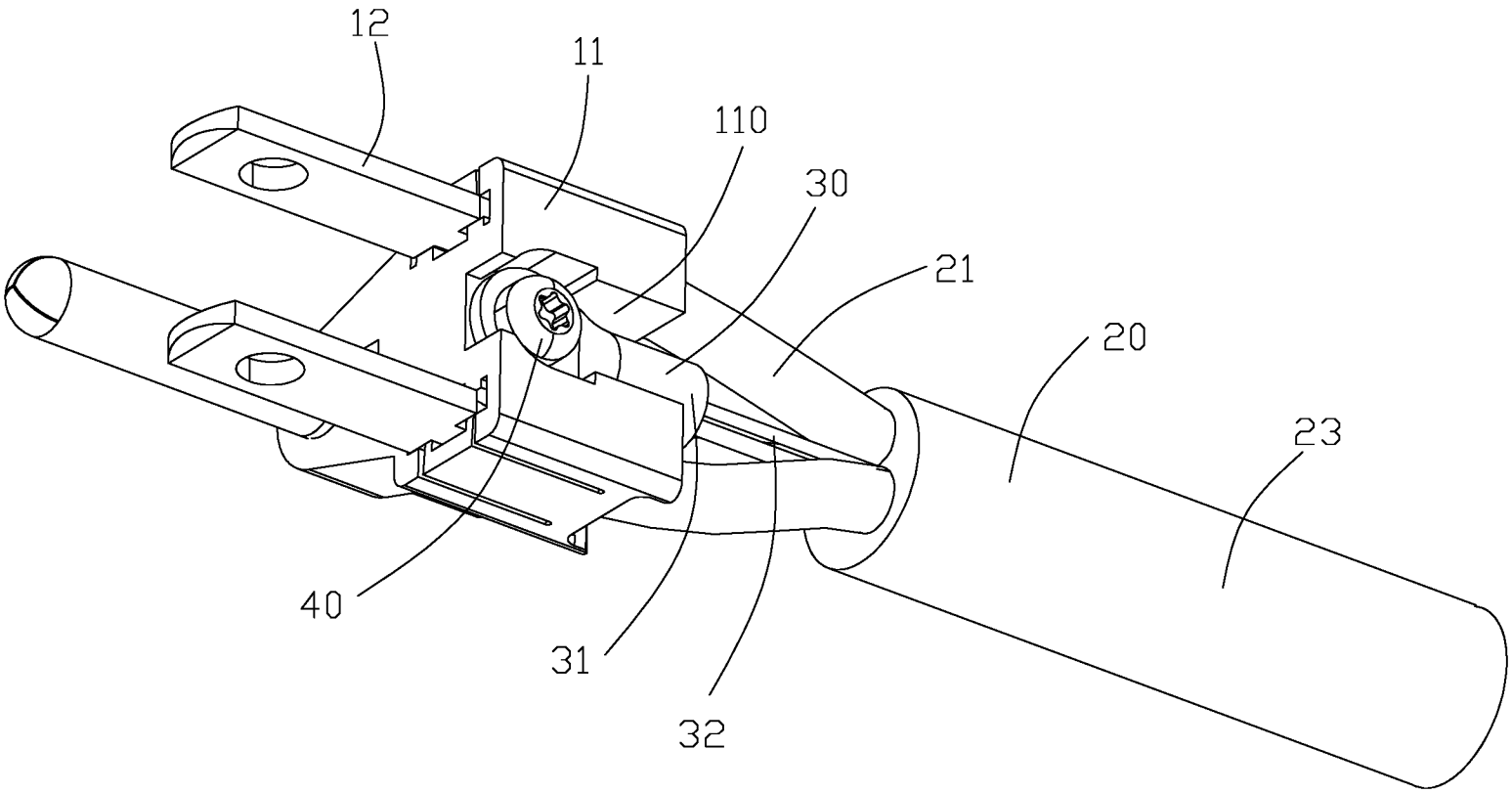
FIG. 2 is a perspective view showing the power cable connector assembly shown in FIG. 1, in accordance with a first embodiment, omitting an outer case.
Figure 3:
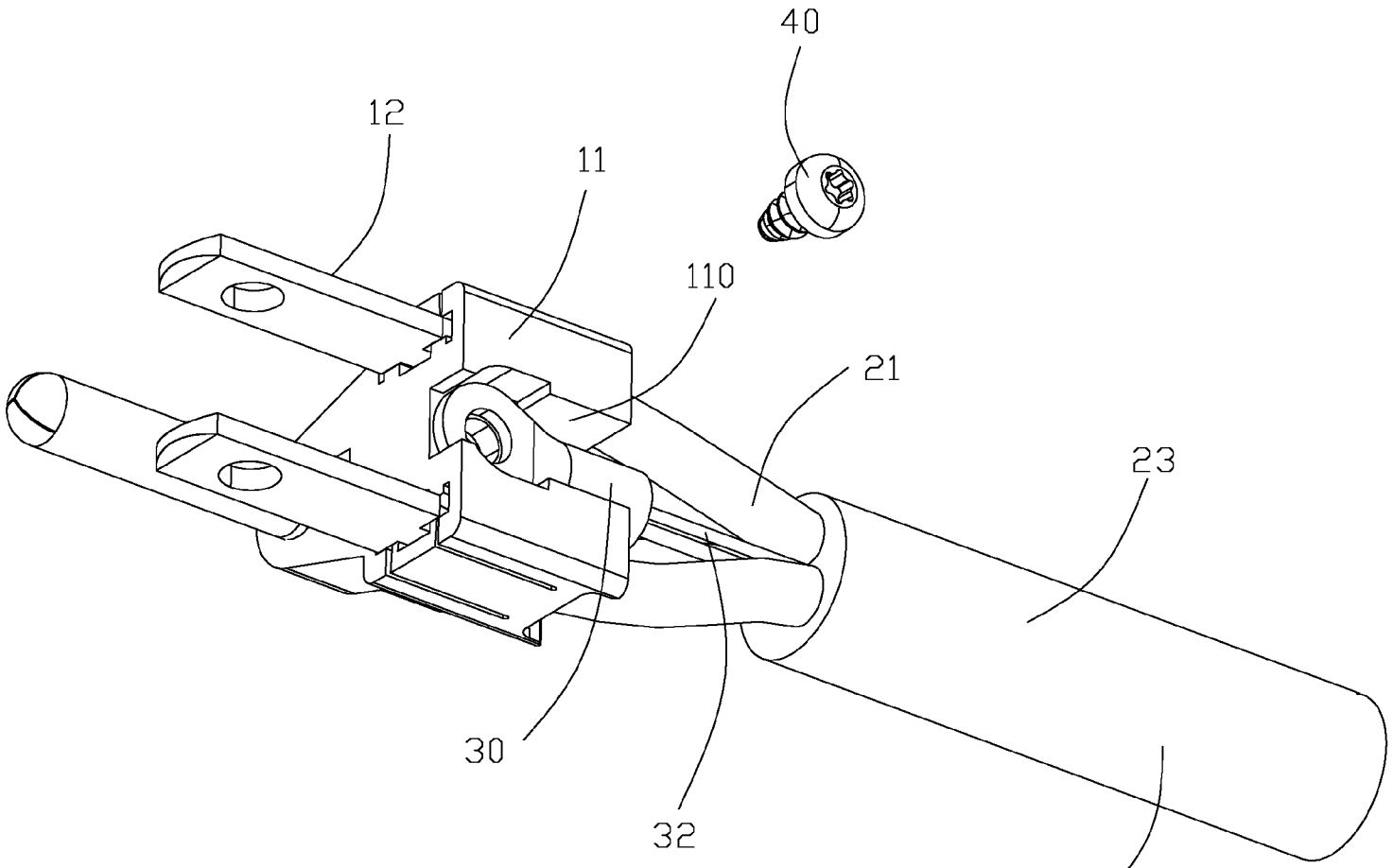
FIG. 3 is a partially exploded view of the power cable connector assembly shown in FIG. 2.
Figure 4:
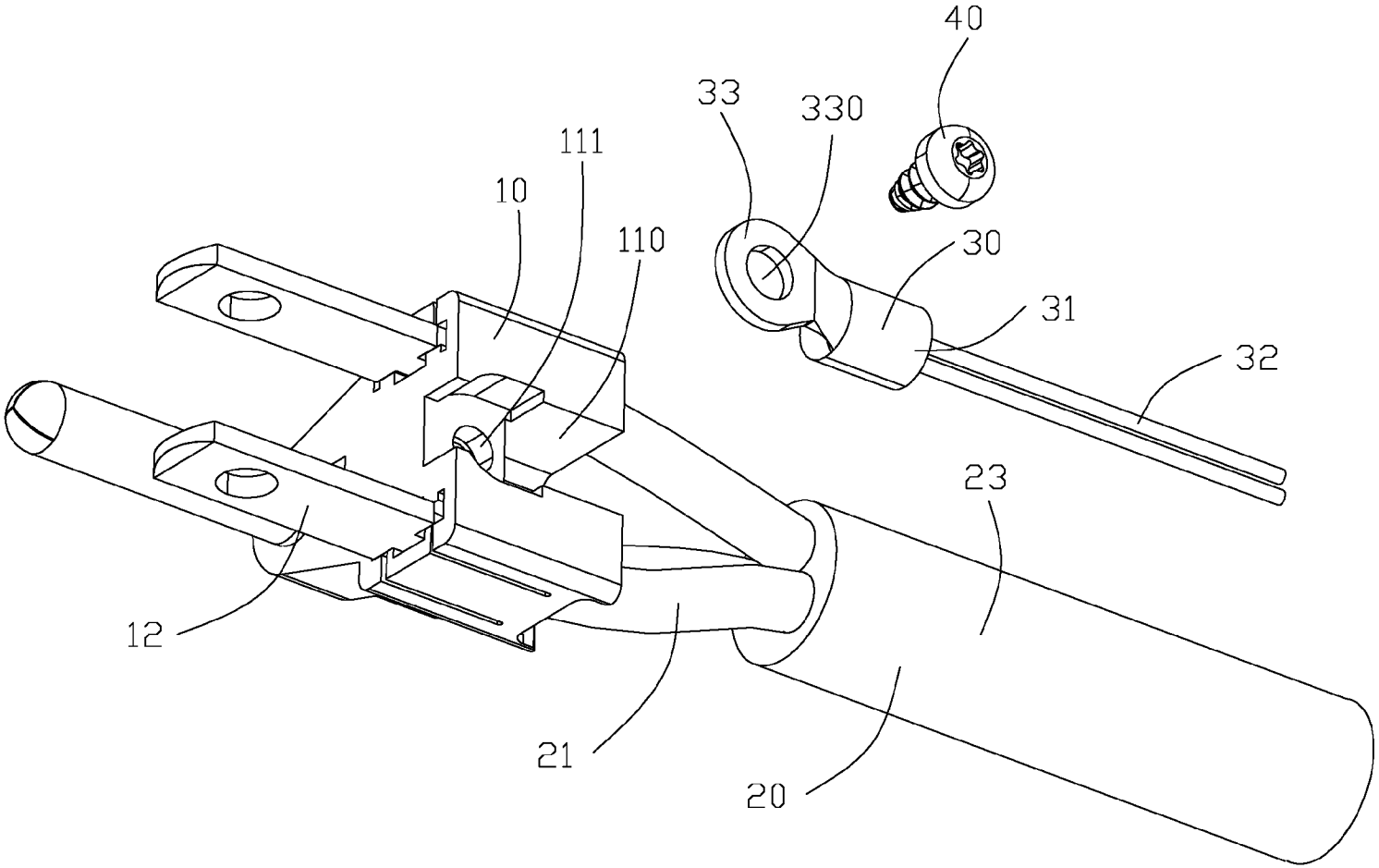
FIG. 4 is a further exploded view of the power cable connector assembly shown in FIG. 3.
Figure 5:
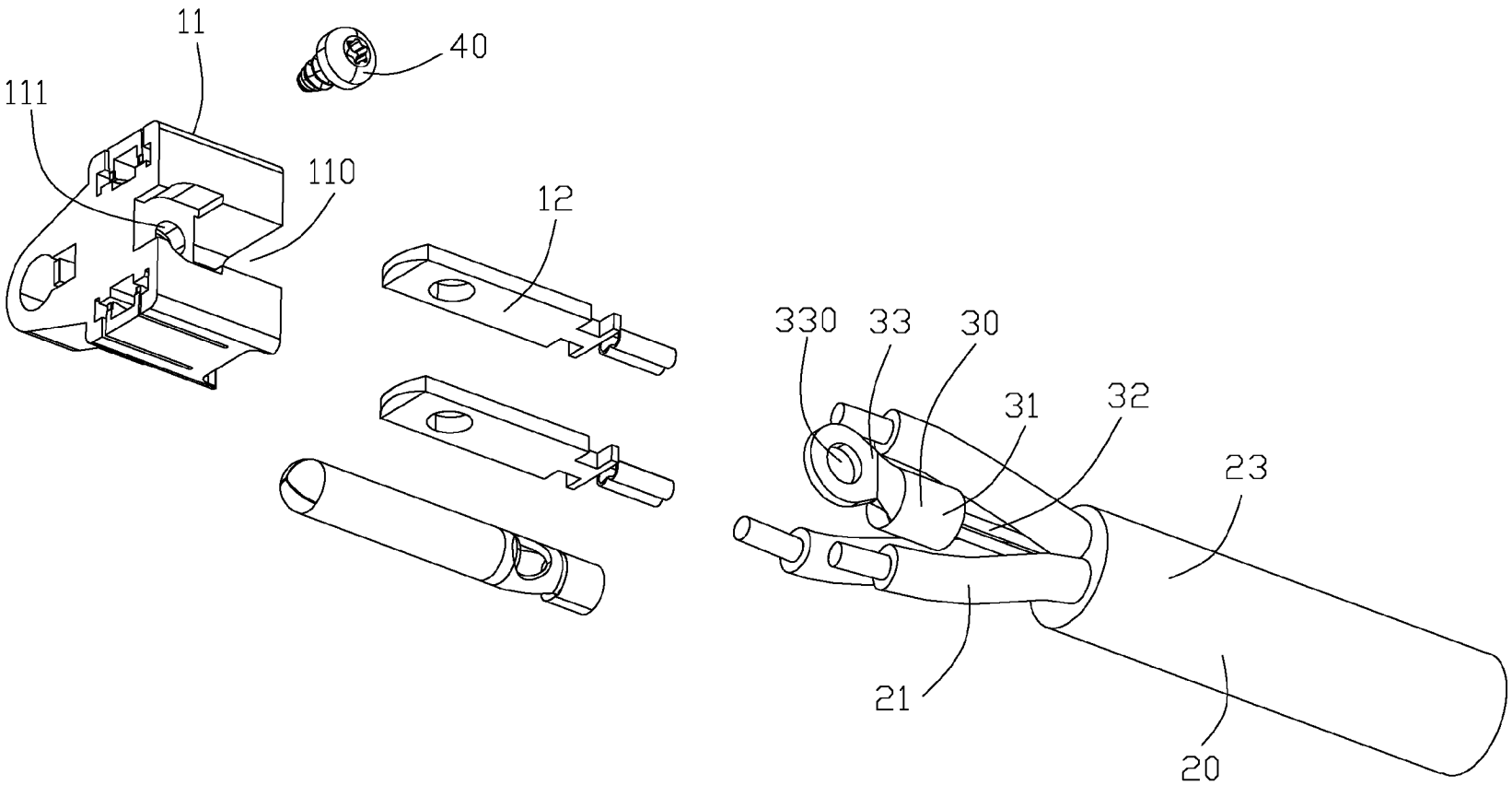
FIG. 5 is an exploded view of the power cable connector assembly shown in FIG. 2.

Reference will now be made to the drawing figures to describe a preferred embodiment of the present invention in detail. Referring to FIGS. 1-12, the power cable connector assembly 100 according to the present invention includes an electrical connector 10, a cable 20 connecting with the electrical connector 10, and a sensor 30. When the sensor 30 detects the heat exceeds a set value, the power cable connector assembly will drop-out current or drop-out voltage.

The power cable connector assembly includes an insulative housing 11, a plurality of contacts 12 retained in the insulative housing 11 and an outer case 13 enclosing the insulative housing 11. The insulative housing 11 defines a depression portion 110 thereon. In the present embodiment, the number of the contacts 12 is three, and two of them are of sheet shape, and another is of columnar shape. In other words, there are two blade type contacts and one columnar type contact thereof, and the depression portion 110 is transversely located between the two blade type contacts. In another embodiment, the number and the shape of contacts 12 are not limited. Users can set the appropriate number and shape according to the specific requirements and applications. The contacts 12 extend to expose to the outer case 13, for being inserted into a mating connector. The material of the outer case 13 is insulation materials. The outer case 13 can be integrally molded in the outside of the insulative housing 11, or be mounted to the insulative housing 11 after being manufactured separately.

The cable 20 includes a plurality of core wires 21 electrically connected with the corresponding contacts 12, a controlling wires (not shown) electrically connected with the sensor 30, and an insulative layer covering the core wires 21 and control wire.

The sensor 30 is enclosed in the outer case 13 and mounted on the insulative housing 11. The sensor 30 includes a main body 31, a pair of conductive wires 32 rearwardly extending from an end of the main body 31, and a mounting portion 33 forwardly extending from another end of the main body 31. The pair of conductive wire 32 is connected to the control wires. The thickness of the mounting portion 33 is smaller than the thickness of the main body 31. The mounting portion 33 defines a through hole 330. The sensor 30 is received in the depression portion 110 of the insulative housing 11, but not exceeding the surface of the insulative housing 11. In details, the mounting portion 33 of the sensor 30 is assembled into the depression portion 110 in a direction toward the columnar contact. When the power cable connector assembly 100 is charging, the resistance of the sensor 30 resistance will increase with the increase of heat, the power cable connector assembly will drop-out electric current or drop-out voltage until the resistance value exceeds a predetermined value.

Referring to FIGS. 2-5, the power cable connector assembly 100 in accordance with a first embodiment further includes a screw 40. The depression portion 110 of the insulative housing 11 defines a screw hole 111 corresponding to the screw 40 therein. The sensor 30 is fixed on the insulative housing 11 by locking the screw 40 into the screw hole 111 through the through hole 330.

Figure 6:
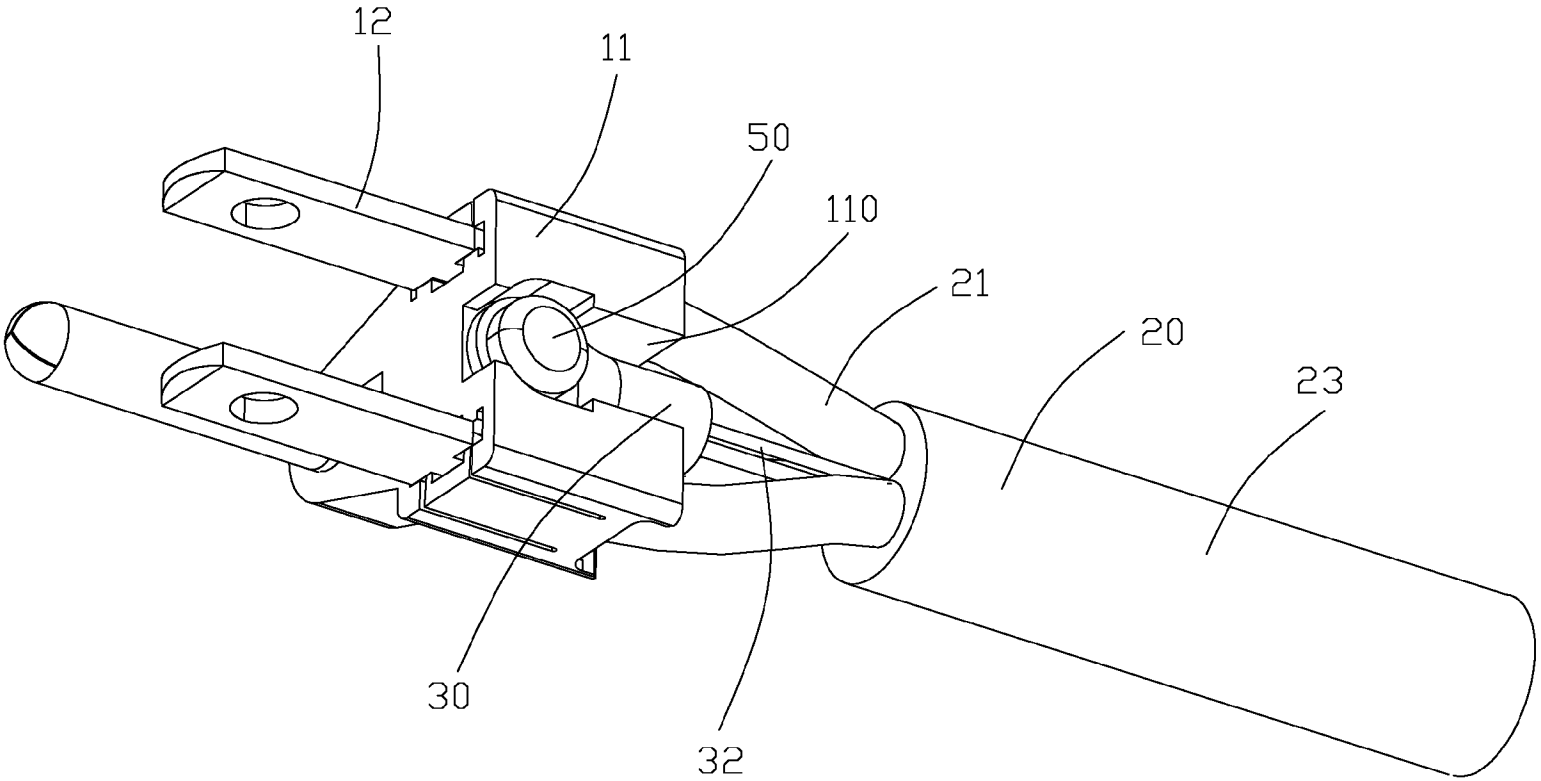
FIG. 6 is a perspective view showing the power cable connector assembly shown in FIG. 1, in accordance with a second embodiment, omitting an outer case.
Figure 7:
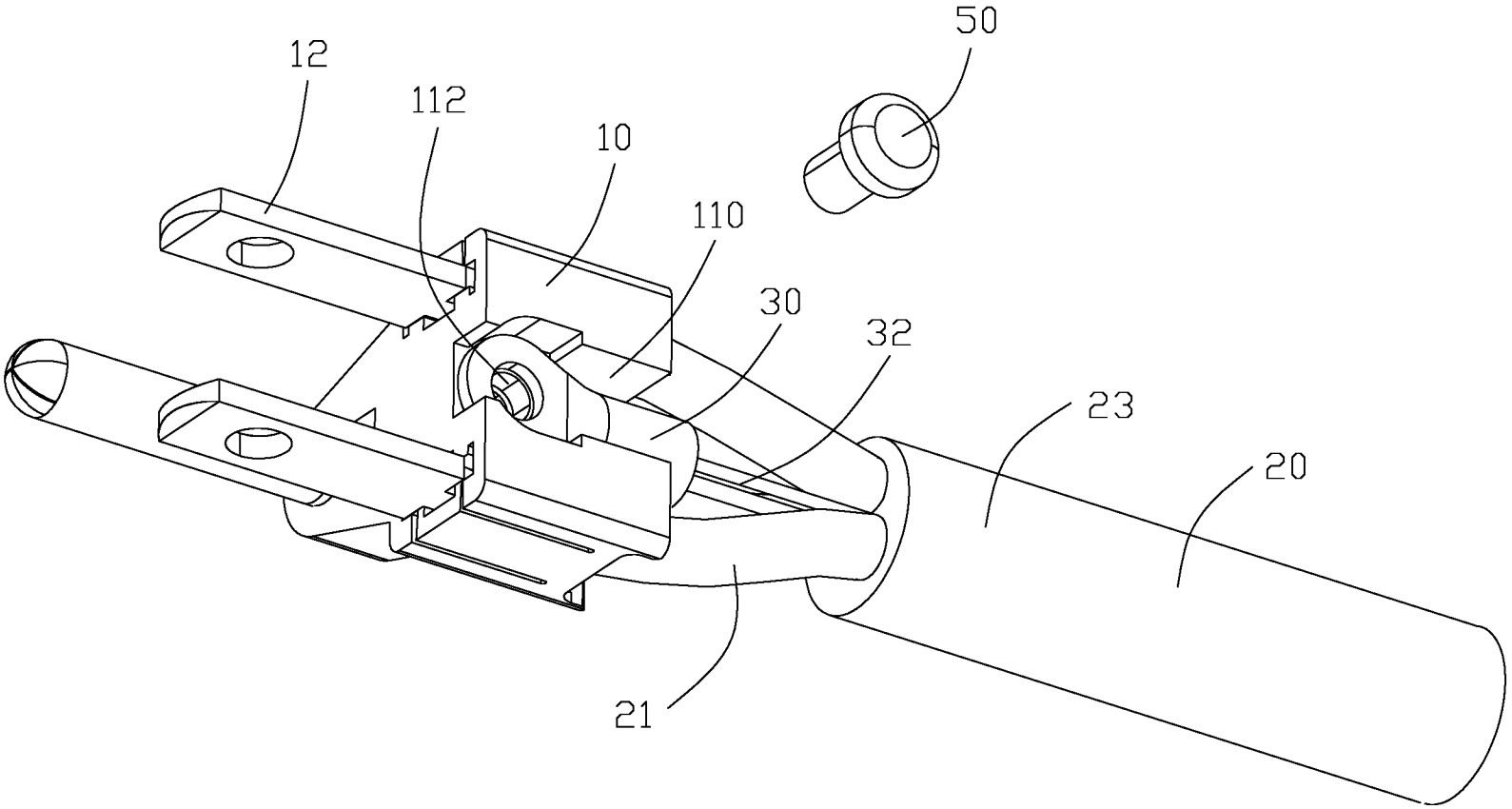
FIG. 7 is a partially exploded view of the power cable connector assembly shown in FIG. 6.
Figure 8:
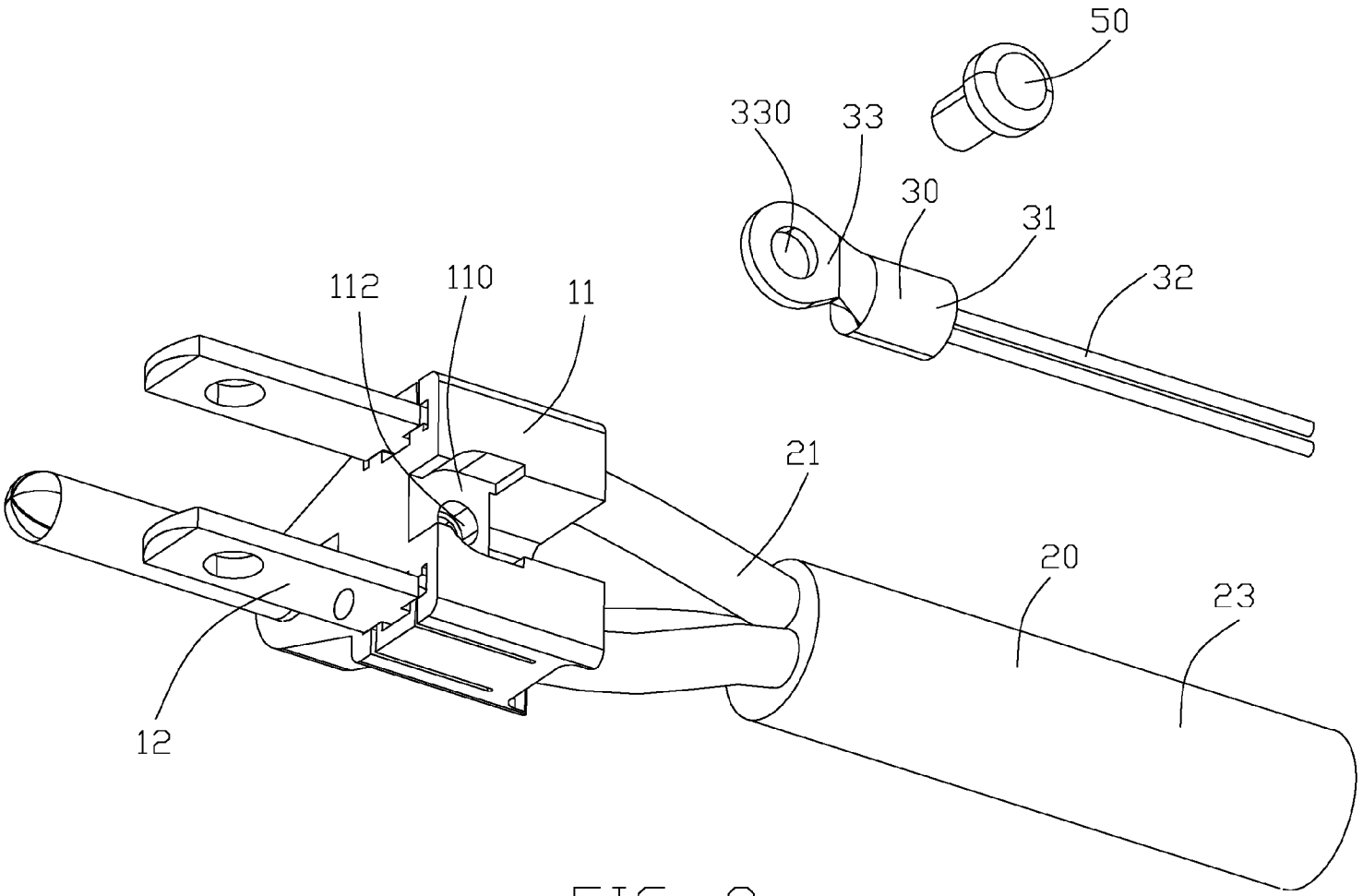
FIG. 8 is a further exploded view of the power cable connector assembly shown in FIG. 7.

Referring to FIGS. 6-8, the power cable connector assembly 100 in accordance with a second embodiment further includes a fitting pin 50. The depression portion 110 of the insulative housing 11 defines a mounting hole 112 corresponding to the fitting pin 50 therein. The sensor 30 is fixed on the insulative housing 11 by locking the fitting pin 50 into the mounting hole 112 through the through hole 330.

Figure 9:
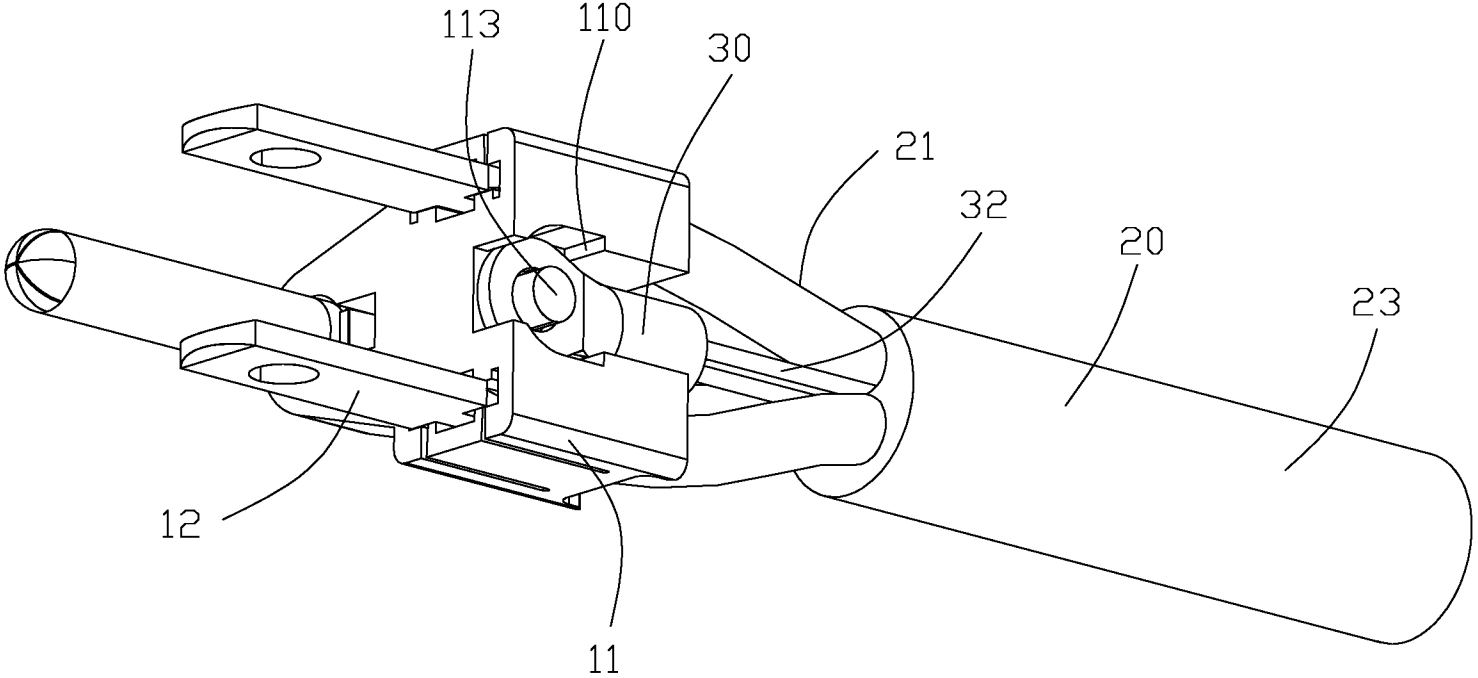
FIG. 9 is a perspective view showing the power cable connector assembly shown in FIG. 1, in accordance with a third embodiment, omitting an outer case.
Figure 10:
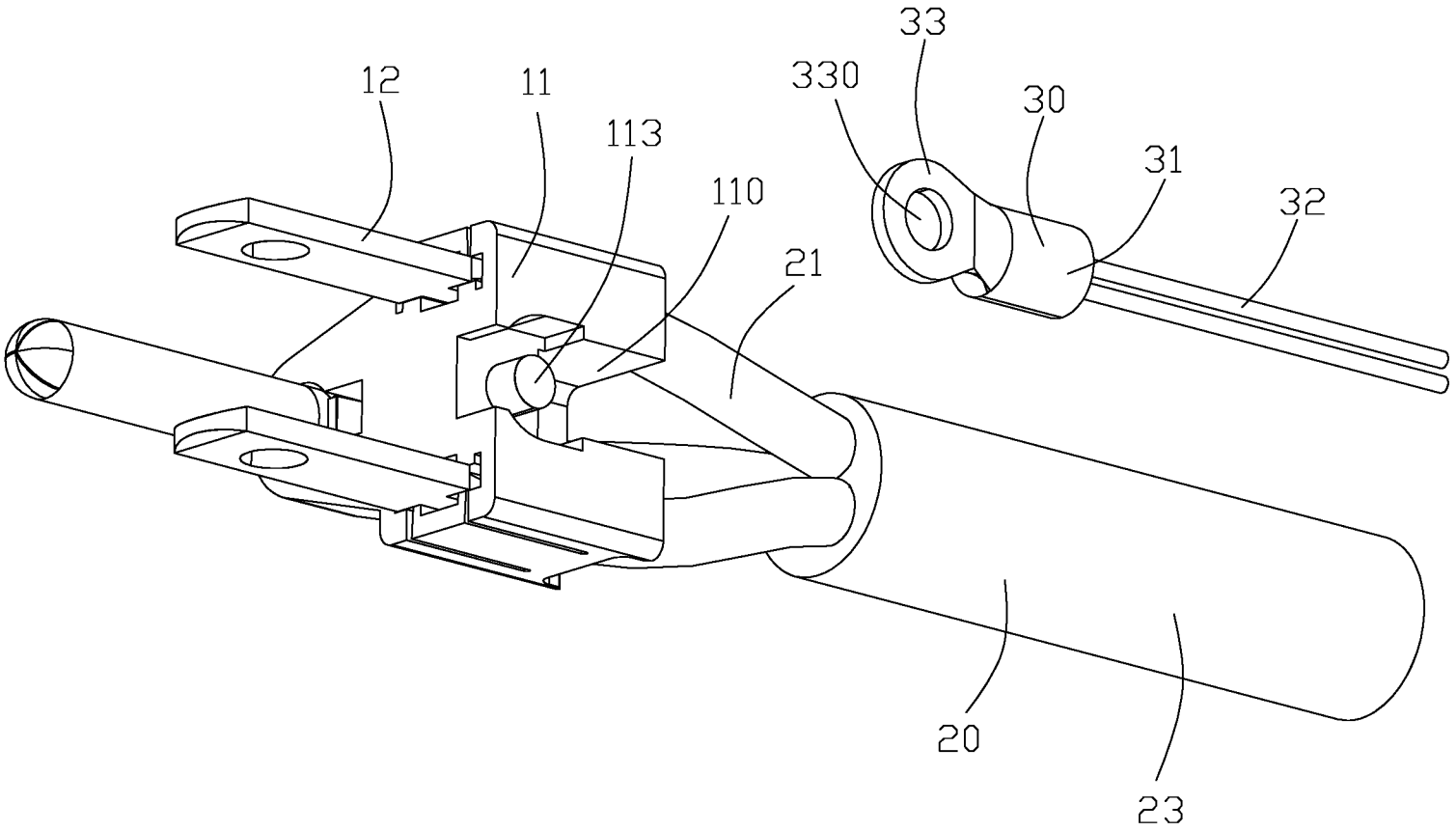
FIG. 10 is a partially exploded view of the power cable connector assembly shown in FIG. 9.
Figure 11:
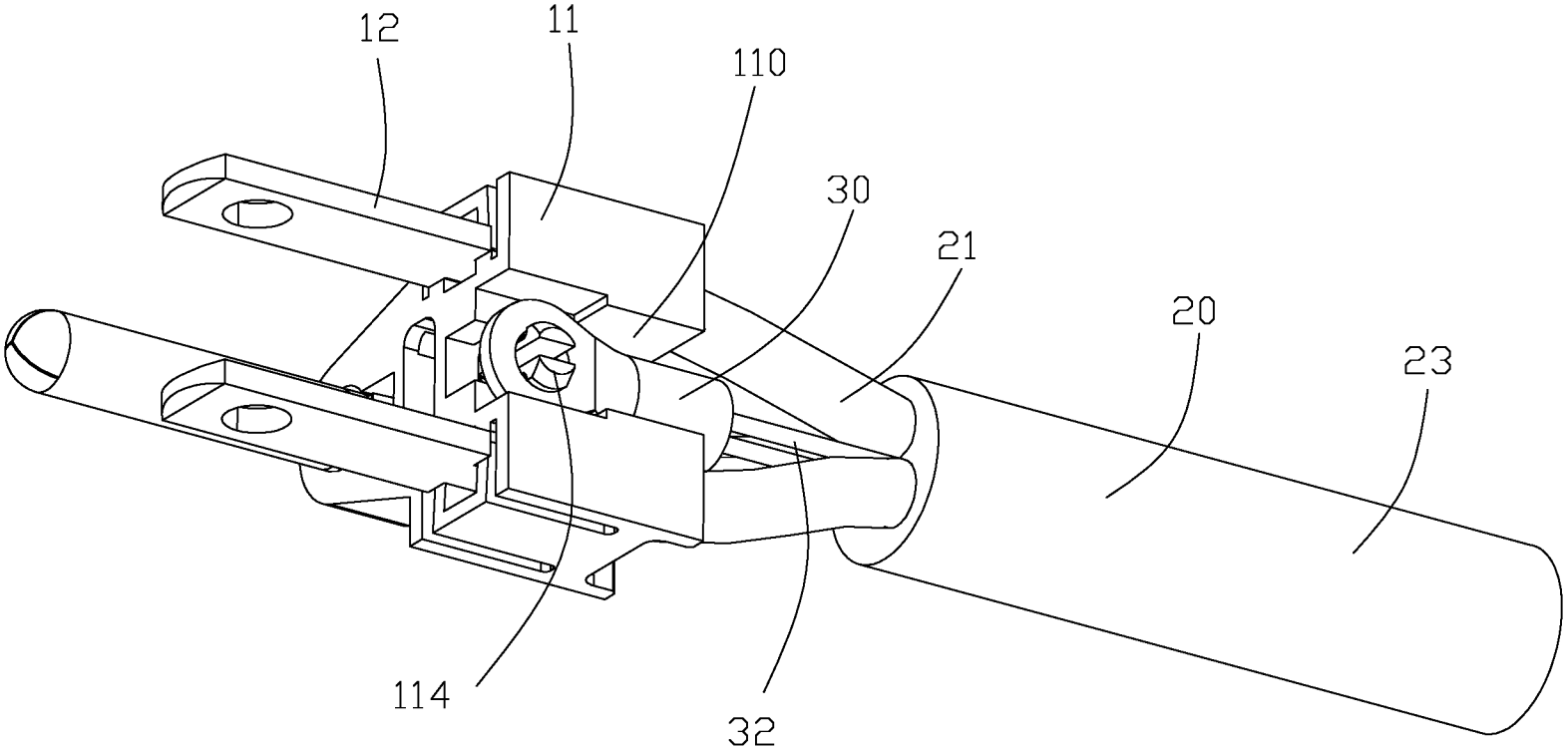
FIG. 11 is a perspective view showing the power cable connector assembly shown in FIG. 1, in accordance with a fourth embodiment, omitting an outer case.
Figure 12:
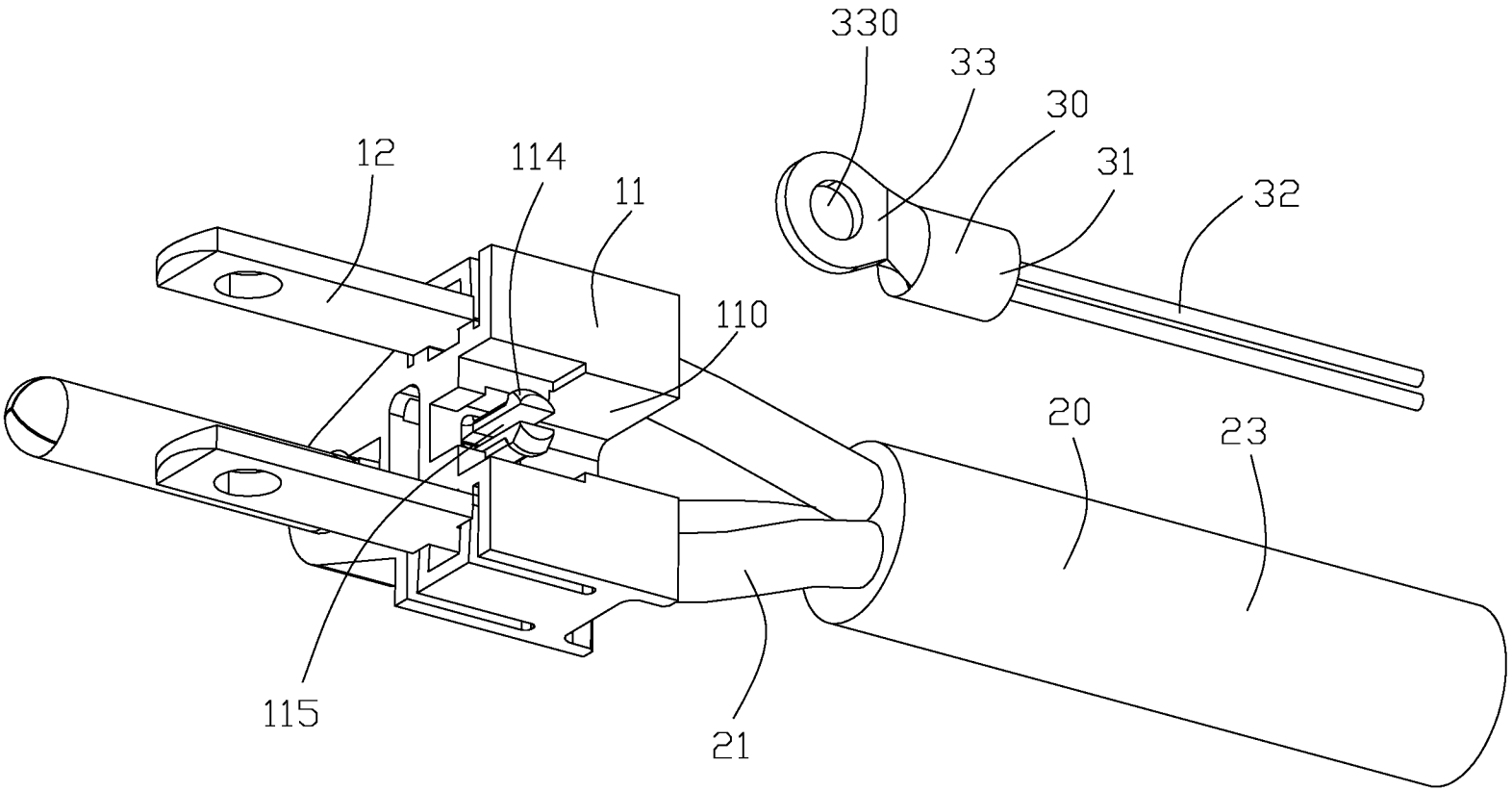
FIG. 12 is a partially exploded view of the power cable connector assembly shown in FIG. 11.

Referring to FIGS. 9-10, the power cable connector assembly 100 in accordance with a third embodiment is shown. In the present embodiment, the depression portion 110 of the insulative housing 11 defines a mounting post 113 thereon. The sensor 30 is fixed on the insulative housing 11 by fixing the mounting post 113 in the through hole 330 using hot melt method.

Referring again to FIGS. 9-10, the power cable connector assembly 100 in accordance with a third embodiment is shown. In the present embodiment, the depression portion 110 of the insulative housing 11 defines a locking post 114 thereon. The locking post 114 defines a slit portion 115 therein, to enhance the elasticity of the locking post 114. The sensor 30 is fixed on the insulative housing 11 by the locking post 114 being locked in the through hole 330.

The power cable connector assembly 100 accordance with the present invention detects the temperature by the sensor 30, thus has a high sensitivity and reliability.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. A power cable connector assembly comprising:

an electrical connector including an insulative housing, a plurality of contacts retained in the insulative housing, and an outer case enclosing the insulative housing;

a cable electrically connecting with the electrical connector, the cable including a plurality of core wires connected with corresponding contacts;

a sensor enclosed by the outer case, the sensor including a plurality of conductive wires and a mounting portion; and a screw; wherein electrical transmission through said core wires is controlled by said sensor;

said mounting portion forms a through hole; and the screw passes through the through hole of the sensor and is locked to the insulative housing.

2. The power cable connector assembly as described in claim 1, wherein the sensor includes a main body and said plurality of conductive wires rearwardly extend from the main body, and the mounting portion forwardly extends from the main body.

3. The power cable connector assembly as described in claim 1, wherein the insulative housing has a depression portion receiving the sensor.

4. The power cable connector assembly as described in claim 3, wherein the sensor is fixed in the depression portion below the surface of the insulating housing.

5. A power cable connector assembly comprising:

an electrical connector including an insulative housing, a plurality of contacts retained in the insulative housing, and an outer case enclosing the insulative housing;

a cable electrically connecting with the electrical connector, the cable including a plurality of core wires connected with corresponding contacts; and a sensor enclosed by the outer case, the sensor including a plurality of conductive wires and a mounting portion; wherein electrical transmission through said core wires is controlled by said sensor;

said mounting portion forms a through hole; and the insulative housing defines a post passing through the through hole of the sensor and fixed in the through hole.

6. The power cable connector assembly as described in claim 5, wherein the sensor includes a main body and said plurality of conductive wires rearwardly extend from the main body, and the mounting portion forwardly extends from the main body.

7. The power cable connector assembly as described in claim 5, wherein the insulative housing has a depression portion receiving the sensor.

8. The power cable connector assembly as described in claim 7, wherein the sensor is fixed in the depression portion below the surface of the insulating housing.

9. The power cable connector assembly as described in claim 5, wherein said mounting portion forms a through hole, and said post is a mounting post fixed in the through hole by hot melting.

10. The power cable connector assembly as described in claim 5, wherein said mounting portion forms a through hole and said post is a locking post with elasticity thereof to be fixed in the through hole.

11. A power cable connector assembly comprising:

an electrical connector including an insulative housing, a plurality of contacts retained in the insulative housing, and an outer case enclosing the insulative housing;

a cable electrically connecting with the electrical connector, the cable including a plurality of core wires connected with corresponding contacts;

a sensor enclosed by the outer case, the sensor including a plurality of conductive wires and a mounting portion; and a fitting pin; wherein electrical transmission through said core wires is controlled by said sensor;

said mounting portion forms a through hole; and the fitting pin passes through the through hole of the sensor and interference fits with the insulative housing.

12. The power cable connector assembly as described in claim 11, wherein the sensor includes a main body and said plurality of conductive wires rearwardly extend from the main body, and the mounting portion forwardly extends from the main body.

13. The power cable connector assembly as described in claim 11, wherein the insulative housing has a depression portion receiving the sensor.

14. The power cable connector assembly as described in claim 13, wherein the sensor is fixed in the depression portion below the surface of the insulating housing.

15. A power cable connector assembly comprising:

an electrical connector including an insulative housing, a plurality of contacts retained in the insulative housing, and an insulative outer case enclosing the insulative housing, said contacts including two blade type contacts and one columnar type contact;

a cable electrically connecting with the electrical connector, the cable including a plurality of core wires connected with corresponding contacts; and a sensor enclosed by the outer case, the sensor including a plurality of conductive wires and a mounting portion; wherein electrical transmission through said core wires is controlled by said sensor;

and the insulative housing forms a depression portion between the two blade type contacts to have said mounting portion assembled therein in a direction toward the columnar contact for retaining the sensor in position in the housing before the insulative outer case encloses the insulative housing and said sensor.

16. The power cable connector assembly as described in claim 15, further including a post extending through the through hole to secure said sensor in position in the housing.

17. The power cable connector assembly as claimed in claim 16, wherein said post is unitarily formed with the housing.

* * * * *